US005450185A

United States Patent [19]

Kuribayashi et al.

[11] Patent Number: 5,450,185

[45] Date of Patent: Sep. 12, 1995

[54] CLEANING BLADE HAVING A WIDTH LONGER THAN THE WIDTH OF THE TRANSFER BELT

[75] Inventors: Ikuo Kuribayashi, Tokyo; Yoshihiro Takada, Kawasaki; Rie Saito, Yokohama, all of Japan

[73] Assignee: Canon Kabushiki Kaisha, Tokyo, Japan

[21] Appl. No.: 170,505

[22] Filed: Dec. 20, 1993

[30] Foreign Application Priority Data

Dec. 24, 1992 [JP] Japan ..... 4-357304

[51] Int. Cl.[6] ..... G03G 21/00

[52] U.S. Cl. ..... 355/299; 355/273; 355/326 R; 15/256.51

[58] Field of Search ..... 355/299, 296, 273, 275, 355/326 R, 327, 215, 271, 212; 15/256.51

[56] References Cited

U.S. PATENT DOCUMENTS

| | | | |
|---|---|---|---|
| 4,170,175 | 10/1979 | Conlon, Jr. | 355/212 X |
| 4,527,686 | 7/1985 | Satoh | 355/212 X |
| 4,982,239 | 1/1991 | Kume et al. | 355/299 X |
| 5,040,028 | 8/1991 | Kamimura et al. | 355/275 |
| 5,225,877 | 7/1993 | Wong | 355/212 |

FOREIGN PATENT DOCUMENTS

| | | | |
|---|---|---|---|
| 60-83068 | 5/1985 | Japan . | |
| 1-13574 | 1/1989 | Japan | 355/299 |
| 2-108091 | 4/1990 | Japan | 355/299 |
| 4-50890 | 2/1992 | Japan . | |

*Primary Examiner*—A. T. Grimley
*Assistant Examiner*—Nestor R. Ramirez
*Attorney, Agent, or Firm*—Robin, Blecker, Daley & Driscoll

[57] ABSTRACT

In an image forming apparatus, residual toner on an image bearing body is prevented from falling on a convey belt which conveys a recording medium. The convey belt is shifted in a direction perpendicular to a convey direction in which the recording medium is conveyed. A cleaning blade for removing residual toner from the image bearing body has a width that is larger than the range in which the convey belt is movable in the direction perpendicular to the convey direction. No cleaning device is required for the convey belt.

5 Claims, 7 Drawing Sheets

CLEANING BLADE HAVING A WIDTH LONGER THAN THE WIDTH OF THE TRANSFER BELT

BACKGROUND OF THE INVENTION

1. Field of the Invention

The present invention relates to an image forming apparatus such as a copying machine, a laser beam printer, and so on, more specifically to an image forming apparatus having a convey belt for conveying a recording material to a transfer position.

2. Related Background Art

FIG. 7 shows a color image forming apparatus of four drum type, which is an example of the image forming apparatus having a convey belt for conveying a recording medium to the transfer position where a developer image formed on an image bearing body is transferred onto the recording medium. In order to achieve speedup, the color image forming apparatus of four drum type has four image forming units. Each image forming unit comprises an image bearing body and process means provided around the image bearing body. Images which are formed in respective image forming units and borne on respective image bearing bodies are transferred, in sequence, onto a recording medium, which is supported and conveyed by a convey means moving in the vicinity of the image bearing bodies.

In the image forming apparatus shown in FIG. 7, the image forming units Pa, Pb, Pc and Pd required to form a full-color image comprise respectively photosensitive drums 51*a*, 51*b*, 51*c* and 51*d* serving as image bearing bodies, and, around these photosensitive drums, chargers (charger means) 52*a*, 52*b*, 52*c* and 52*d*, optical scanning devices (optical scanning means, not shown), developer devices (developer means) 53*a*, 53*b*, 53*c* and 53*d*, and cleaners (cleaning means) 54*a*, 54*b*, 54*c* and 54*d*. Also, these image forming units have, in common, an endless transfer belt 55. Reference numerals 56*a*, 56*b*, 56*c* and 56*d* denote transfer charger devices for transferring color images formed on the photosensitive drums 51*a*, 51*b*, 51*c* and 51*d* of respective image forming units onto the recording medium 57 which is supported on and conveyed by the transfer belt 55. The recording medium 57 is supplied from a sheet supply cassette 58, and after the transfer process separated from the transfer belt 55. Subsequently, the images are fixed by a fixing device 59, and the recording medium 55 is discharged onto a discharge tray 60.

The cleaners 54*a*, 54*b*, 54*c* and 54*d* have their respective cleaning blades 61*a*, 61*b*, 61*c* and 61*d* made of elastic material such as polyurethane rubber and remove residual toner on the photosensitive drums 51*a*, 51*b*, 51*c* and 51*d*. Cleaners of this type have been widely used because of their simple construction and small size.

However, toner may splash from longitudinal ends of the cleaning blades 61*a*, 61*b*, 61*c* and 61*d* of the cleaners 54*a*, 54*b*, 54*c* and 54*d*, probably because the toner which is not scraped from the image bearing body by the cleaning blade to remain between the cleaning blade and the image bearing body moves, while intercepted by the cleaning blade, toward the longitudinal ends of the cleaning blade as the image bearing body rotates.

Therefore, in order to prevent the toner from splashing from the ends of the cleaning blade, the ends of the blade are sealed by sealing members of felt, urethane foam, or the like. In this case, however, if the sealing members are pressed against the ends of the blade very hard in order to completely prevent toner splash, the blade receives excessive stress and is distorted. Then, the contact pressure of the blade against the image bearing body becomes nonuniform along the longitudinal direction (that is, the direction of the axis of the image bearing body), and the toner on the image bearing body can not be cleaned properly. Accordingly, it is difficult to completely seal the ends of the blade with the sealing members. Especially in an apparatus which reciprocates its cleaning blade in the direction of the rotation shaft of the photosensitive drum when the photosensitive drum is rotated, gaps easily occur between the ends of the blade and the sealing members. Moreover, more toner is pushed toward the ends of the blade by the reciprocating motion of the blade. Accordingly, more toner splashes through the gaps between the blade and the sealing member.

As the toner is intercepted halfway at the ends of the blade, much of it falls vertically (downwards) as lumps. If the transfer belt 55 is arranged right under the cleaners 54*a*, 54*b*, 54*c* and 54*d*, as shown in FIG. 7, the toner may fall on the transfer belt 55 and blot it. Once the toner blots the transfer belt 55, other parts in the apparatus may be blotted too by the toner carried by the belt, and functions of the apparatus may be deteriorated.

In order to remove the toner on the transfer belt 55, a cleaner 62 may be provided, as shown in FIG. 7. However, when the transfer belt 55 receives the load from the cleaner 62 for cleaning the transfer belt 55, the transfer belt 55 generates small irregular vibration. So, especially at the time of the transfer operation, the toner images on the photosensitive drum can not be transferred accurately onto the recording medium, which may deteriorate the quality of the resultant image.

SUMMARY OF THE INVENTION

The present invention was made in consideration of the above-mentioned problems. An object of the present invention is to provide an image forming apparatus which can prevent the toner from blotting the belt for conveying the recording medium without providing a particular cleaner for cleaning the belt.

Another object of the present invention is to provide an image forming apparatus in which the slide width (width in the direction vertical to that of conveyance) of the recording medium conveyer belt is narrower than the longitudinal dimension of the cleaning means.

Other objects of the present invention will be understood from the detailed description below with reference to the accompanied drawings.

DETAILED DESCRIPTION OF THE PREFERRED EMBODIMENTS

Figure 3:
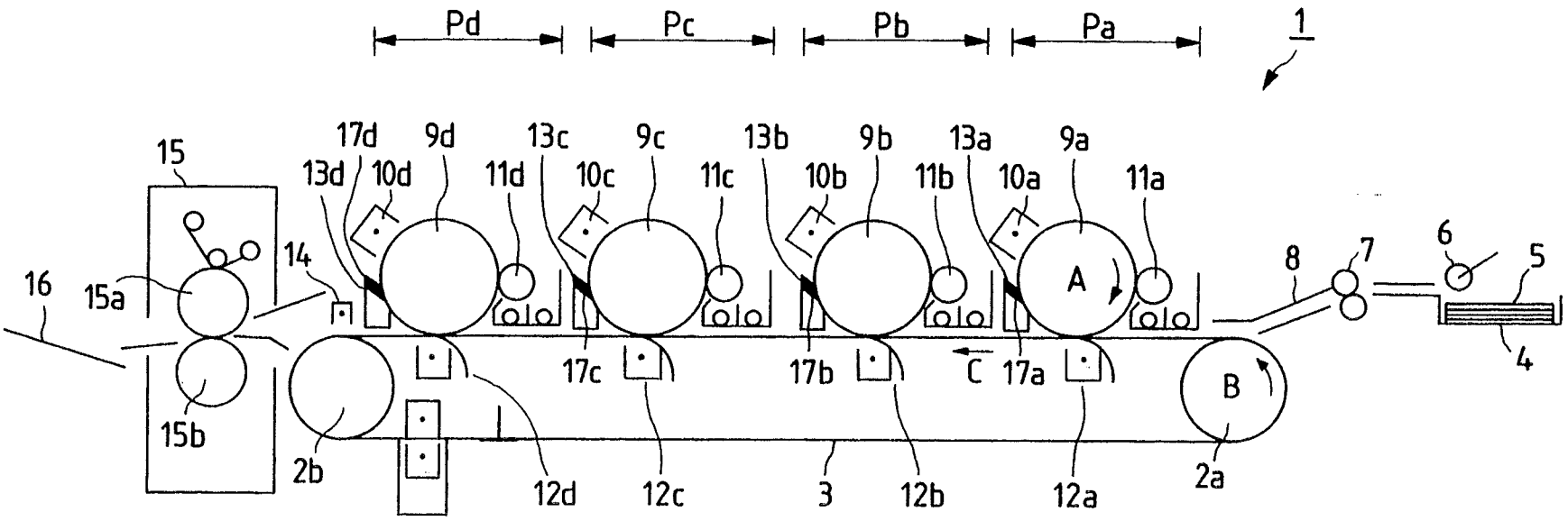
FIG. 3 is an explanatory cross-sectional view showing the general construction of the copying machine according to the present invention.

FIG. 3 shows an embodiment of the image forming apparatus to which the present invention is applied.

The color copying machine of four drum type shown in FIG. 3 has, in order to achieve speedup, four image forming units. Each image forming unit has an image bearing body and process means arranged around the image bearing body. Images on the image bearing bodies, which are formed in respective image forming units, are transferred in sequence onto a recording medium which is supported and conveyed by a conveyer means moving in the vicinity of the image bearing bodies.

More specifically, in the apparatus main body 1, image forming units Pa, Pb, Pc and Pd containing process means are aligned along the direction in which the recording medium is conveyed. Beneath these image forming units Pa, Pb, Pc and Pd, a transfer belt 3 serving as an endless conveyer belt member is set around driving rollers 2*a* and 2*b*, which serve as a belt support mechanism. A drive motor (not shown) rotates the belt driving rollers in the direction of the arrow B in order to move the transfer belt 3 as shown by the arrow C.

A cassette 4 contains recording medium 5, which are picked up one by one by a pick-up roller 6. Skew feed of the recording medium 5 is corrected by a pair of resist rollers 7. The corrected recording medium 5 is conveyed by the transfer belt 3 whose movement is synchronized with the image forming units Pa, Pb, Pc and Pd. A conveyance guide 8 guides the recording medium 5 from the pair of resist rollers 7 onto the transfer belt 3.

Now, the construction of the image forming units Pa, Pb, Pc and Pd will be described. The image forming units Pa, Pb, Pc and Pd comprise respective photosensitive drums 9*a*, 9*b*, 9*c* and 9*d*, and around the photosensitive drums respective process means consisting of primary charger devices 10*a*, 10*b*, 10*c* and 10*d*, developer devices 11*a*, 11*b*, 11*c* and 11*d*, transfer charger devices 12*a*, 12*b*, 12*c* and 12*d*, and cleaning devices 13*a*, 13*b*, 13*c* and 13*d*. Over the photosensitive drums 9*a*, 9*b*, 9*c* and 9*d*, respective laser beam scanners (not shown) are provided as exposure means.

The primary charger devices 10*a*, 10*b*, 10*c* and 10*d* uniformly charge the surfaces of the photosensitive drums 9*a*, 9*b*, 9*c* and 9*d*, respectively with electricity before the exposure operation. The developer devices 11*a*, 11*b*, 11*c* and 11*d* visualize the electrostatic latent images formed on the exposed surfaces of the drums by applying toner of black, magenta, yellow and cyan. The transfer charger devices 12*a*, 12*b*, 12*c* and 12*d* transfer the toner image formed on the photosensitive drums 9*a*, 9*b*, 9*c* and 9*d* onto the recording medium 5. The cleaning device 13*a*, 13*b*, 13*c* and 13*d* remove residual toner on the drum surfaces after the toner images are transferred. Each laser beam scanner comprising a semiconductor laser, a polygonal mirror, a $\theta$ lens, and so on. The laser beam scanners receive electric digital image signals and illuminate respective photosensitive drums 9*a*, 9*b*, 9*c* and 9*d* with laser beams modulated according to the received signal and emitted in the directions of the generating lines of the photosensitive drums.

A separation charger device 14 separates the recording medium 5 conveyed by the transfer belt 3 from the belt. A fixing device 15 for fixing the images transferred onto the recording medium 5 has a fixing roller 15*a* containing a heat means such as a heater and a pressure roller 15*b* pressing the fixing roller 15*a*. The recording medium 5 ejected out of the apparatus is stacked on an eject tray 16.

Next, the image forming operation will be described. When an image forming operation start signal is applied to the apparatus main body 1, the photosensitive drum 9*a* starts rotating as indicated by the arrow A in FIG. 3. The photosensitive drum 9*a* is uniformly charged by the primary charger device 10*a* and illuminated with the laser beam emitted from the laser beam scanner (not shown), wherein the laser beam is modulated according to the image signal which corresponds to the black component of the original image. Thus, the electrostatic latent image is formed (exposure operation). Subsequently, the developer device 11*a* applies yellow toner to visualize the latent image and form the toner image.

At the same time, the recording medium 5 contained in the cassette 4 is picked up by the pick-up roller 6. The skew feed of the recording medium 5 is corrected by the pair of resist rollers 7 while the rollers are not driven. Then, the recording medium 5 is conveyed by the transfer belt 3 whose movement is synchronized with the formation of the toner image on the photosensitive drum 9*a*. The recording medium 5 conveyed to the transfer position of the image forming unit Pa by the transfer belt 3 is transfer-charged by the transfer charger device 12*a*. Thus, the toner image is transferred onto the recording medium 5. Similar operation is repeated in the image forming units Pb, Pc and Pd, thereby transferring the magenta toner image, the cyan toner image and the black toner image in sequence onto the same recording medium 5.

After transferring the toner images, the recording medium 5 on the left edge of the transfer belt 3 is subjected to AC electricity removing operation of the separation charger device 14. The recording medium 5 separated from the transfer belt 3 is sent to the fixing device 15, where the toner images are fixed on the recording medium 5. Then, the recording medium 5 is discharged out of the apparatus onto the discharge tray 16.

Now the relations between the transfer belt 3 and cleaning blades in the first embodiment of the present invention will be described. The transfer belt 3 is moved when the driving rollers 2*a* and 2*b* rotate, wherein the transfer belt is gradually shifted in the direction vertical to the convey direction of the recording medium 5. For the diameters of the driving rollers 2*a* and 2*b* are not uniform along their axes (the nonuniformity occurred in the production of the rollers), and there is an error of positioning of the driving rollers 2*a* and 2*b* in the apparatus main body (the error in parallelization of the rollers).

In order to solve the problem, the amount of shift vertical to the conveyance direction of the transfer belt 3 is detected. According to the detected amount of shift, such force that cancels the shift of the transfer belt 3 is given to the transfer belt 3. Thus, the amount of shift is restricted so that the transfer belt 3 moves zigzag within a predetermined movable range.

Figure 2A:
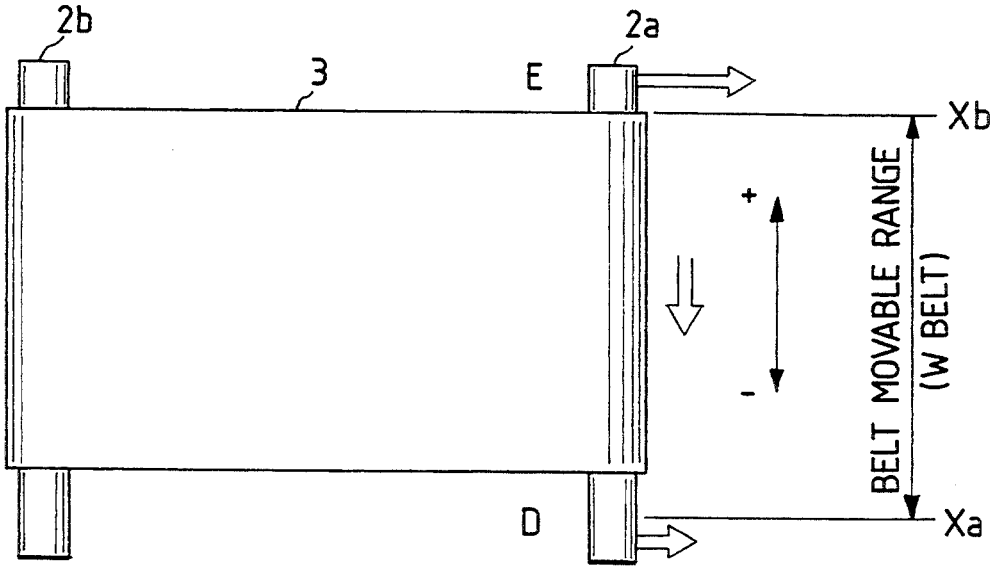
FIGS. 2A and 2B are explanatory views showing the transfer belt movable range.
Figure 2B:
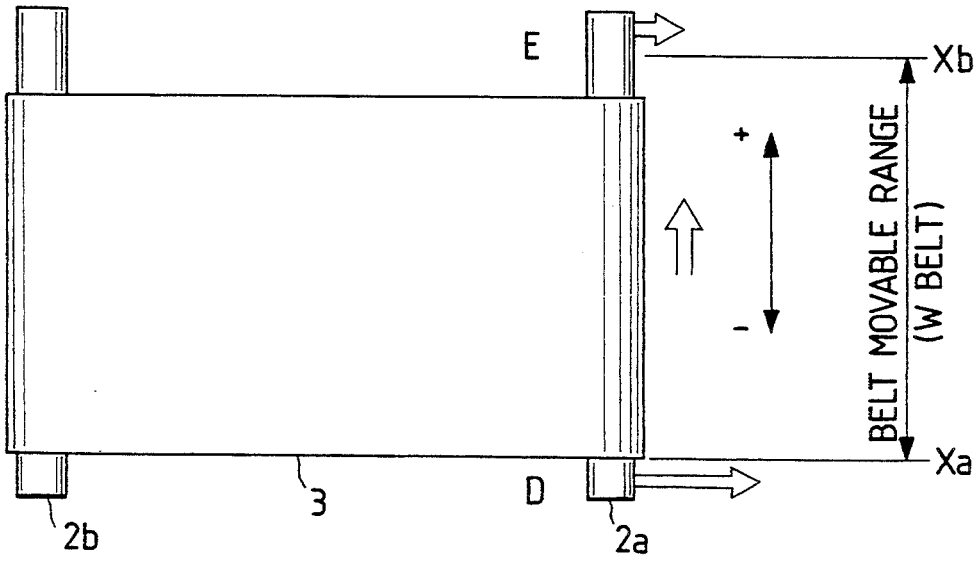

More specifically, as shown in FIG. 2A, if one of the side edges of the transfer belt 3 (the upper edge in the drawings) comes to the maximum plus-direction shift position Xb, the tension given to the side E of the transfer belt 3 is made larger than the tension given to the D side so that the transfer belt 3 is forced to shift in the minus direction. On the other hand, as shown in FIG. 2B, when the opposite side edge of the transfer belt 3 (the lower edge in the drawing) comes to the maximum minus-direction shift position Xa, the tension given to the side D of the transfer belt 3 is made larger than the tension given to the side E so that the transfer belt 3 is forced to shift in the plus direction.

By applying tension to the transfer belt 3 according to the detected amount of shift in the manner described above, the transfer belt 3 is constantly forced to move zigzag within the predetermined movable range of a width Wa (that is, between Xa and Xb). Thus, accidents such as damage to the transfer belt 3 can be prevented.

The cleaning devices 13*a*, 13*b*, 13*c* and 13*d* use cleaning blades 17*a*, 17*b*, 17*c* and 17*d* made of elastic material such as polyurethane rubber in order to remove residual toner on the photosensitive drums 9*a*, 9*b*, 9*c* and 9*d*, respectively. These cleaning blade have simple construction and can be prepared at a low cost. But it is difficult to completely prevent the toner from splashing from the longitudinal ends of the cleaning blades 17*a*, 17*b*, 17*c* and 17*d* of the cleaning devices 13*a*, 13*b*, 13*c* and 13*d*.

In order to solve the problem, in this embodiment of the present invention, the width W, that is, the longitudinal dimension of the cleaning blades 17*a*, 17*b*, 17*c* and 17*d* and the width Wa of the transfer belt movable range in the direction vertical to the conveyance direction of the recording medium 5 satisfy the condition:

$$W \geqq Wa \text{ (more preferably } W > Wa).$$

Figure 1:
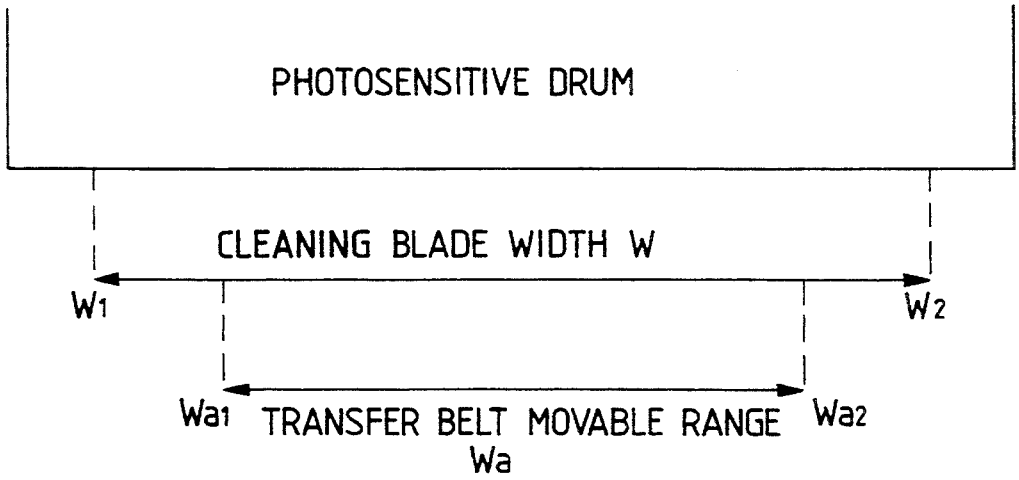
FIG. 1 is an explanatory view showing the arrangement of the cleaning blade width and the transfer belt movable range in the first embodiment of the present invention.

More specifically, the positions $W_1$ and $W_2$ of respective longitudinal ends of the cleaning blades 17*a*, 17*b*, 17*c* and 17*d* are arranged outward with respect to both of the edges $Wa_1$ and $Wa_2$ of the transfer belt movable range (see FIG. 1). In said arrangement, even when the toner falls vertically (downwards) from the ends of the cleaning blades 17*a*, 17*b*, 17*c* and 17*d*, the toner does not fall on the transfer belt 3. Thus, the toner is not carried by the transfer belt 3 to other parts in the apparatus. In addition, a cleaner for cleaning the transfer belt 3 is not needed.

Incidentally, the driving rollers 2*a* and 2*b* employed in the first embodiment around which the transfer belt 3 is set do not have to have a shape having the same diameter along its axis.

Figure 4A:
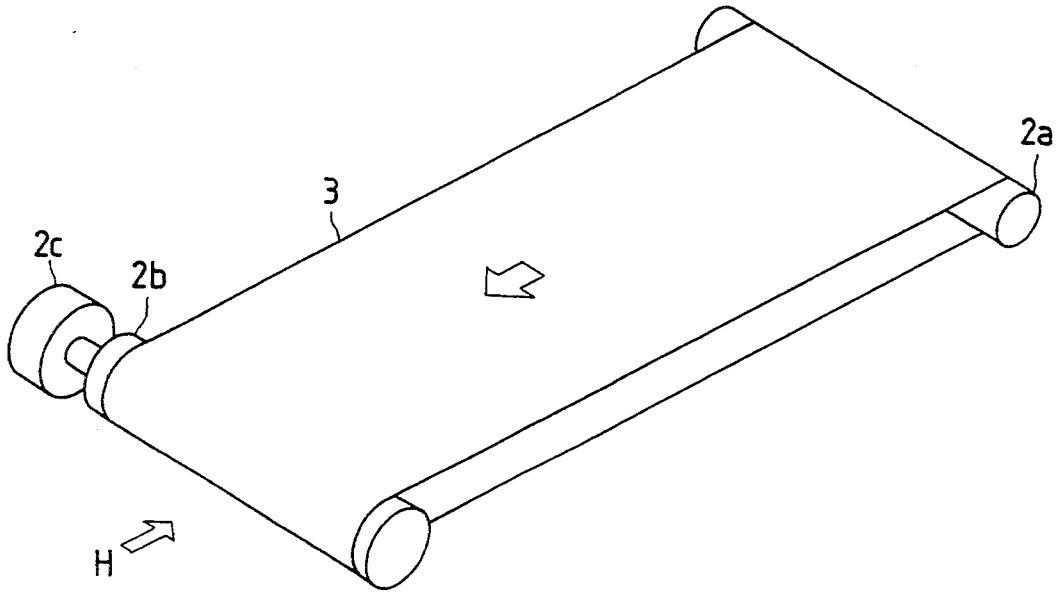
FIGS. 4A and 4B are explanatory views showing another example of the belt driving roller.
Figure 4B:
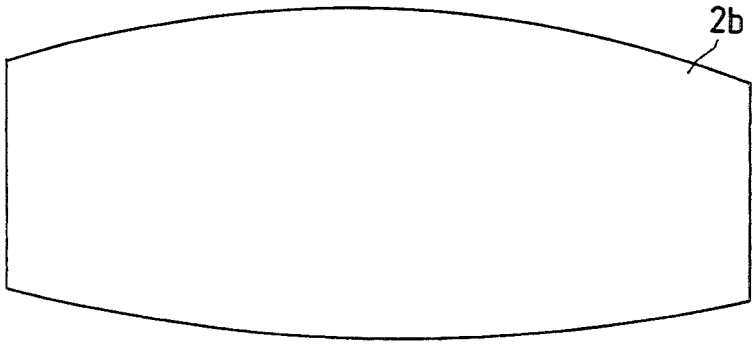

FIGS. 4A and 4B show an example of the recording medium conveyer means according to the present invention, wherein the driving rollers 2*a* and 2*b* have a shape different from that of the driving rollers 2*a* and 2*b* described before. FIG. 4A shows the belt driving rollers 2*a* and 2*b* and the transfer belt 3 set around the driving rollers 2*a* and 2*b*. FIG. 4B shows the belt driving roller 2*b* (having the same shape as the belt driving roller 2*a*), seen as indicated by the arrow H in FIG. 4A.

As the shape of the belt driving rollers 2*a* and 2*b* is not that of a pillar having the same diameter along its axis, but that of a crown shape which is larger in the intermediate portion than in the end portions, the shift of the transfer belt 3 is restricted. Compared with the previously described mechanism to restrict the transfer belt 3 within its movable range, these modified belt driving rollers 2*a* and 2*b* advantageously simplify the construction of the apparatus and reduce the manufacturing cost. Incidentally, the reference numeral 2C in FIG. 4A denotes a drive motor for driving the belt driving roller 2*b* and the roller 2*a* receives torque via the transfer belt 3.

If the curvature of the crown shape of the belt driving rollers 2*a* and 2*b* shown in FIG. 4B is made greater, the shift and the zigzag movement of the transfer belt 3 is restricted within a narrower range. In this case, however, problems such as permanent distortion of the transfer belt 3 caused by creep strain arise. So, the transfer belt 3 should be made of materials with great elasticity and thickened to obtain sufficient mechanical strength. However, when the transfer belt 3 is thickened, more electrical current is required to carry out transfer operation, which increase the cost of running the apparatus. On balance, the shape (curvature) of the belt driving rollers 2*a* and 2*b* and the width Wa of the movable range of the transfer belt 3 should be determined in consideration of the material, shape, and so on of the transfer belt 3, as well as various conditions concerning the mechanical constitution.

Next, the second embodiment of the present invention will be described.

In the apparatus of this embodiment, in order to improve the cleaning capacity of the cleaning devices 13*a*, 13*b*, 13*c* and 13*d*, the cleaning blades 17*a*, 17*b*, 17*c* and 17*d* which come into contact with respective photosensitive drums 9*a*, 9*b*, 9*c* and 9*d* are reciprocated along the rotation shafts of the photosensitive drums 9*a*, 9*b*, 9*c* and 9*d*.

Figure 5A:
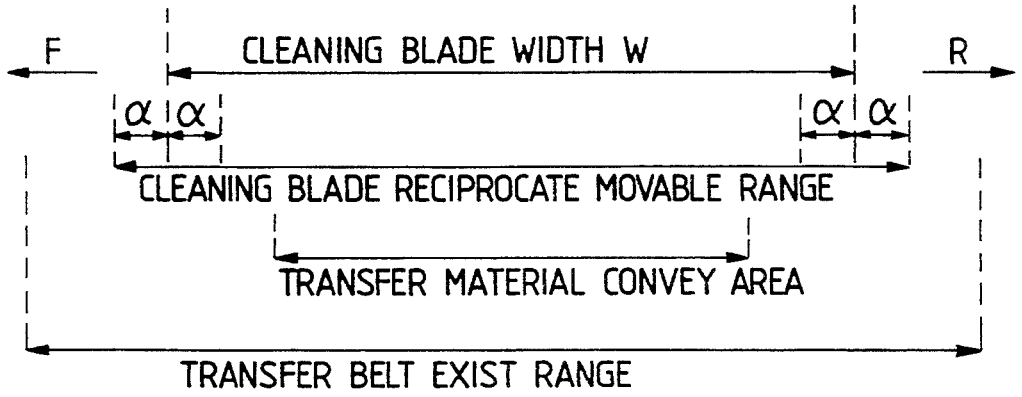
FIGS. 5A to 5C are views illustrating a problem concerning the arrangement of the cleaning blade movable range and the transfer belt movable range.
Figure 5B:
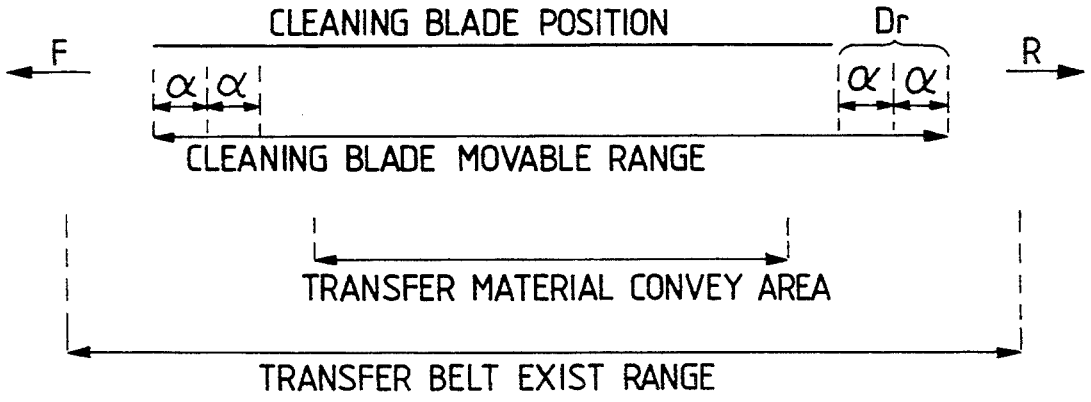
Figure 5C:
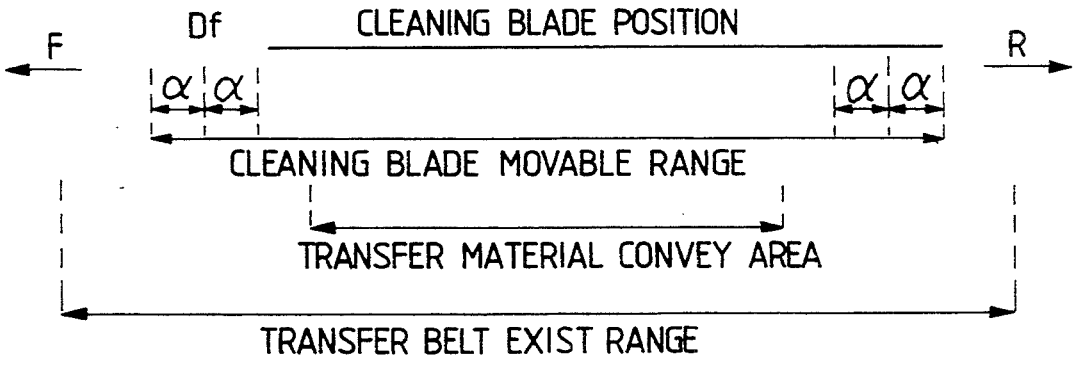

FIGS. 5A to 5C, which help to understand the second embodiment, illustrate a problem concerning the arrangement of the cleaning blade width, the recording medium convey area and the transfer belt movable range.

As described before, when the cleaning blades 17*a*, 17*b*, 17*c* and 17*d* are reciprocated in parallel with the axes of the photosensitive drums 9*a*, 9*b*, 9*c* and 9*d*, more toner tends to fall from the ends of the cleaning blades 17*a*, 17*b*, 17*c* and 17*d* than when they are not reciprocated. Moreover, unless the sealing members follow the reciprocating ends of the cleaning blades 17*a*, 17*b*, 17*c* and 17*d*, there occur gaps between the ends of the blades 17*a*, 17*b*, 17*c* and 17*d* and the seal members. Therefore, it is far more difficult for the sealing members to prevent the toner from splashing than in the apparatus of the first embodiment in which the cleaning blades 17*a*, 17*b*, 17*c* and 17*d* stand still.

Suppose that the cleaning blades 17*a*, 17*b*, 17*c* and 17*d* reciprocated in the direction parallel with the axes of the photosensitive drums 9*a*, 9*b*, 9*c* and 9*d* as indicated by the arrows F and R in FIG. 5A, are shifted by the distance $\alpha$ from the center of their reciprocating motion. In this case, when the ends (left end in the drawings) of the cleaning blades 17*a*, 17*b*, 17*c* and 17*d* reach the maximum F-direction shift position as shown in FIG. 5B, the blades 17*a*, 17*b*, 17*c* and 17*d* do not exist in the range Dr in FIG. 5B, where the surfaces of the photosensitive drums 9*a*, 9*b*, 9*c* and 9*d* are exposed to the toner falling between the ends of the cleaning blades 17*a*, 17*b*, 17*c* and 17*d* and the sealing members. Similarly, when the opposite ends (right end in the drawings) of the cleaning blades 17*a*, 17*b*, 17*c* and 17*d* reach the maximum R-direction shift position as shown in FIG. 5C, toner may easily fall in the range Df where the cleaning blades 17*a*, 17*b*, 17*c* and 17*d* do not exist.

In order to solve the above-mentioned problem, in this second embodiment, the width W (longitudinal dimension) of the cleaning blades 17*a*, 17*b*, 17*c* and 17*d*, and the width Wa of the movable range of the transfer belt 3 satisfy the condition;

$$W \geqq Wa + 2\alpha$$

In this case, both ends of each cleaning blade 17*a*, 17*b*, 17*c* and 17*d* reciprocated in the direction of the axes of the photosensitive drums 9*a*, 9*b*, 9*c* and 9*d* remain always outward from the transfer belt 3. Thus, the toner which splashes from the ends of the cleaning blades 17*a*, 17*b*, 17*c* and 17*d* do not blot the transfer belt 3. Accordingly, the transfer operation can be carried out excellently.

Figure 6:
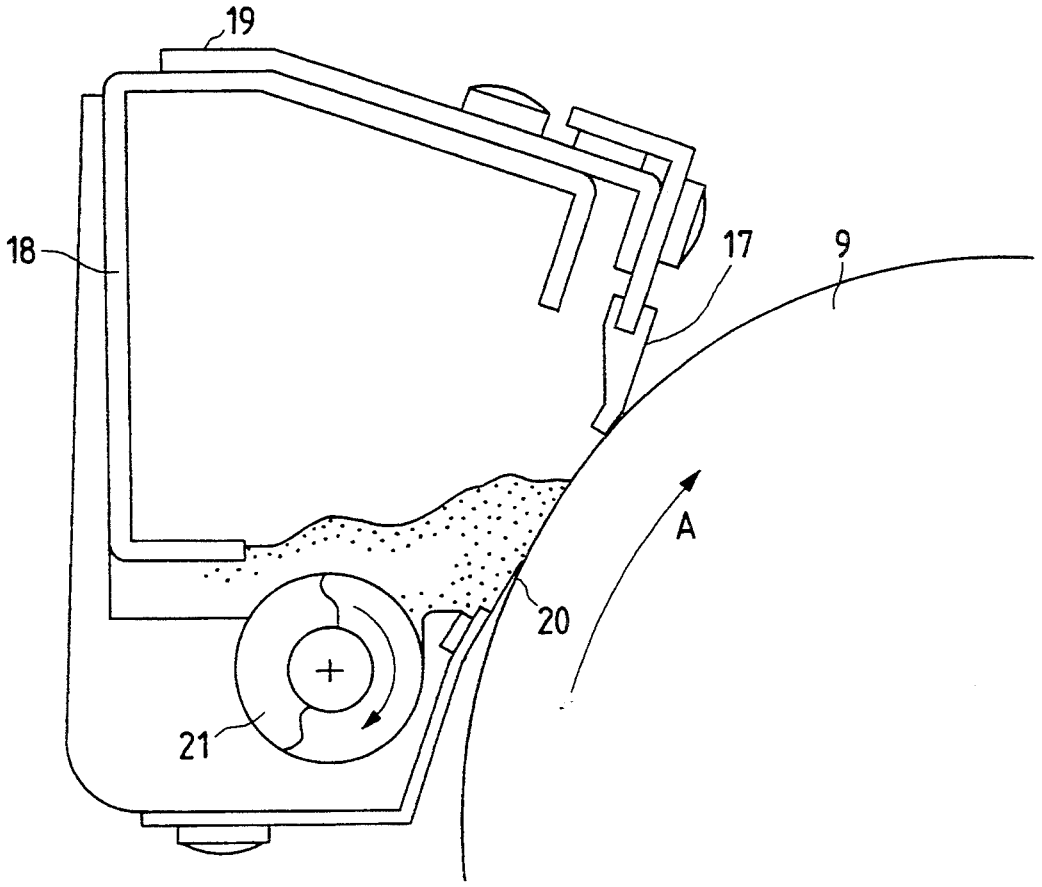
FIG. 6 is an enlarged view showing another example of the cleaning means.
Figure 7:
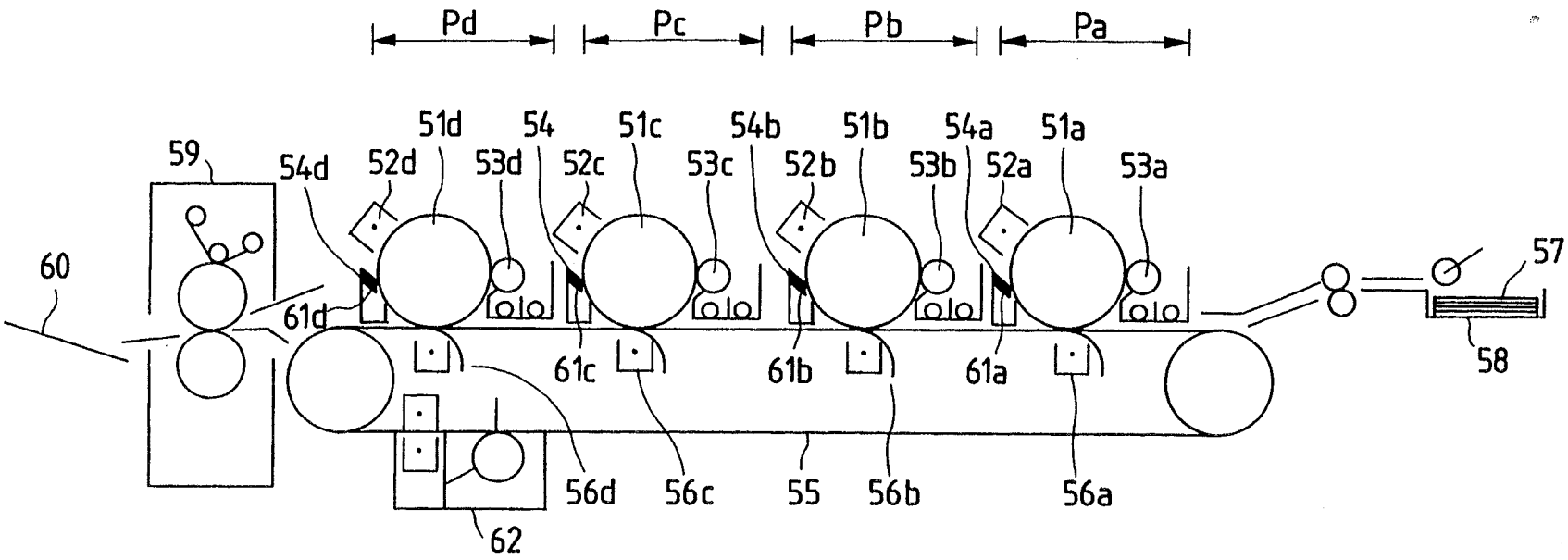
FIG. 7 (PRIOR ART)
FIG. 7 is an explanatory cross-sectional view showing the construction of a conventional copying machine.

FIG. 6 is a cross-sectional view of the cleaning device according to the present invention.

As described before, the cleaning blades 17*a*, 17*b*, 17*c* and 17*d* (hereinafter referred to simply as "cleaning blade(s) 17") of the cleaning devices 13*a*, 13*b*, 13*c* and 13*d* ("cleaning device(s)" 13) are pressed against the surfaces of the photosensitive drums 9*a*, 9*b*, 9*c* and 9*d* ("photosensitive drum(s)" 9) with their front edges directed in the direction opposite to the direction of rotation indicated by the arrow A. The cleaning blade 17 is fixed with a screw to a blade holder 19 of a cleaner box 18 with its front edge pressed against the photosensitive drum 9. The blade holder is arranged downstream in the direction of the rotation of the photosensitive drum 9 with respect to the cleaning blade 17. A dip sheet 20 for collecting the toner scraped by the cleaning blade 17 is fixed to the cleaner box 18. The dip sheet 20 is arranged upstream in the direction of the rotation of the photosensitive drum 9 with respect to the cleaning blade 17. A conveyer screw 21 conveys the collected toner.

As the residual toner on the photosensitive drum 9 is charged with electricity, it is attracted onto the surface of the photosensitive drum 9 because of strong electrostatic attraction. Therefore, the cleaning blade 17 should be strongly pressed against the surface of the photosensitive drum 9 so as to remove the toner particles from the surface of the photosensitive drum 9 in spite of the electrostatic attraction.

The cleaning blade 17 is generally made of polyurethane rubber in consideration of chemical resistance, wear and abrasion resistance, moldability, mechanical strength, and so on. The coefficient of friction between polyurethane rubber and the surface of the OPC photosensitive drum 9 whose surface layer is made of polymer resin such as polycarbonate is very large. So, strong frictional force generated between the photosensitive drum 9 and the cleaning blade 17 may turn the front edge of the cleaning blade 17 toward the direction of the rotation of the photosensitive drum 9 (turn-over of the blade). In this case, the photosensitive drum 9 can not be driven, or the cleaning operation can not be carried out properly.

Actually, some of the toner scraped by the cleaning blade 17 remains between the cleaning blade 17 and the photosensitive drum 9 and acts as lubricating particles which prevent said turn-over of the blade 17. According to the present invention, however, the width W of the cleaning blade 17 is much greater than the width of the image forming area of the photosensitive drum 9. Accordingly, toner does not exist between the photosensitive drum 9 and the end portions of the cleaning blade 17, where frictional force between the photosensitive drum 9 and the cleaning blade 17 may become greater enough to cause turn-over of the blade 17. In order to solve the problem, at least either the surface of the photosensitive drum 9 or that of the cleaning blade 17 may be subjected to frictional force reduction treatment. Such treatment can prevent turn-over of the blade 17 without the toner between the cleaning blade 17 and the photosensitive drum 9 and facilitate effective cleaning operation.

According to the experiment made by the inventions, the frictional force between the cleaning blade 17 made of polyurethane rubber and the OPC photosensitive drum 9 whose surface-layer is made of polymer resin such as polycarbonate can be remarkably reduced by dispersing 10% of lubricative particles such as teflon (trade mark) over the surface of the OPC photosensitive drum 9 or by coating the surface of the drum with a polycarbonate thin layer in which the same lubricating particles are dispersed. Otherwise, the frictional force between the photosensitive drum 9 and the cleaning blade 17 can be also remarkably reduced by coating the surface of the cleaning blade with a resin layer. The resin layer employed was prepared by dispersing graphite fluoride powder in the solvent for polymer resin such as nylon, coating the cleaning blade 17 with the resultant solvent by the dipping method, drying the coated cleaning blade 17, and curing the resin layer on the surface of the cleaning blade 17 with heat.

Thus, the apparatus having the above-mentioned construction can prevent the toner splashing from the ends of the cleaning blade 17 from blotting the transfer belt 3 as well as prevent turn-over of the cleaning blade 17.

As described above, according to the present invention, the toner falling from the ends of the cleaning blades does not stick to the transfer belt. Accordingly, the toner does not blot rest of the interior of the apparatus.

Note that the present invention is not limited to the above-mentioned embodiments but includes all the modifications which fall within the range of technical ideas of the present invention.

What is claimed is:

1. An image forming apparatus, comprising:

an image bearing body;

image forming means for forming a toner image on said image bearing body;

transfer means for transferring the toner image formed on said image bearing body onto a recording medium conveyed to a transfer position;

a convey belt for conveying the recording medium to the transfer position, said convey belt sliding in a direction perpendicular to a convey direction of the recording medium; and cleaning means for removing residual toner on said image bearing body;

wherein said cleaning means has a width larger than a width of a movable range of said convey belt sliding in the direction perpendicular to the convey direction of the recording medium.

2. An image forming apparatus according to claim 1, further comprising correction means for returning said convey belt in the direction reverse to the sliding direction, when said convey belt slides in the direction perpendicular to the convey direction.

3. An image forming apparatus according to claim 1, wherein said cleaning means can reciprocate in a longitudinal direction thereof.

4. An image forming apparatus according to claim 1, wherein said convey belt is arranged beneath said cleaning means in a direction in which gravity acts.

5. An image forming apparatus according to claim 1, wherein said cleaning means has a blade member pressed against said image bearing body to remove residual toner.

* * * * *

UNITED STATES PATENT AND TRADEMARK OFFICE

CERTIFICATE OF CORRECTION

PATENT NO. : 5,450,185

DATED : September 12, 1995

INVENTOR(S) : Ikuo Kuribayashi et al.

It is certified that error appears in the above-indentified patent and that said Letters Patent is hereby corrected as shown below:

Col. 3, line 64. Before "θ" insert -- f --.

Col. 5, line 20. Change "blade" to -- blades --.

Col. 8, line 30. After "blot" insert -- the --.

Signed and Sealed this

Nineteenth Day of December, 1995

*Attest:*

Bruce Lehman

BRUCE LEHMAN

*Attesting Officer*

*Commissioner of Patents and Trademarks*